US010006725B2

(12) United States Patent
Nikaido et al.

(10) Patent No.: US 10,006,725 B2
(45) Date of Patent: Jun. 26, 2018

(54) HEAT SOURCE SYSTEM AND METHOD FOR CONTROLLING NUMBER OF MACHINES TO BE STARTED AT TIME OF POWER RECOVERY IN HEAT SOURCE SYSTEM

(71) Applicant: MITSUBISHI HEAVY INDUSTRIES, LTD., Tokyo (JP)

(72) Inventors: Satoshi Nikaido, Tokyo (JP); Takaaki Miura, Tokyo (JP); Minoru Matsuo, Tokyo (JP); Koki Tateishi, Tokyo (JP); Toshiaki Ouchi, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 537 days.

(21) Appl. No.: 14/374,762

(22) PCT Filed: Feb. 8, 2013

(86) PCT No.: PCT/JP2013/053137
§ 371 (c)(1),
(2) Date: Jul. 25, 2014

(87) PCT Pub. No.: WO2013/122017
PCT Pub. Date: Aug. 22, 2013

(65) Prior Publication Data

US 2015/0039134 A1 Feb. 5, 2015

(30) Foreign Application Priority Data

Feb. 13, 2012 (JP) ..... 2012-028618

(51) Int. Cl.
*G05D 23/00* (2006.01)
*F28F 27/00* (2006.01)
(Continued)

(52) U.S. Cl.
CPC ..... *F28F 27/00* (2013.01); *F25B 1/10* (2013.01); *F25B 40/02* (2013.01); *F25B 41/043* (2013.01);
(Continued)

(58) Field of Classification Search
CPC ..... G05B 15/02; G06Q 10/00; G05F 1/70; F01K 13/02; H05K 7/20763; F28F 27/00
See application file for complete search history.

(56) References Cited

U.S. PATENT DOCUMENTS

2001/0010032 A1* 7/2001 Ehlers ..... G05B 15/02 702/62
2010/0125370 A1 5/2010 Baba et al.
(Continued)

FOREIGN PATENT DOCUMENTS

CN 101737867 A 6/2010
JP 06-313637 A 11/1994
(Continued)

OTHER PUBLICATIONS

International Search Report dated Apr. 23, 2013, issued in corresponding application No. PCT/JP2013/053137.
(Continued)

*Primary Examiner* — Tuan Vu
(74) *Attorney, Agent, or Firm* — Westerman, Hattori, Daniels & Adrian, LLP

(57) ABSTRACT

To swiftly start, at the time of power recovery after a power failure, heat source machines, the number of which is equal to the number of machines before the power failure, without including an uninterruptible power supply in an apparatus for controlling the number of machines that is adapted to control the number of heat source machines. There is provided a heat source system, in which a host control device (20) includes a nonvolatile first storage unit (22) that
(Continued)

stores the number of heat source machines in operation immediately before the power failure. When power is recovered, control on the number of heat source machines at the time of power recovery is performed in accordance with the number of heat source machines stored in the first storage unit (22).

6 Claims, 6 Drawing Sheets

(51) Int. Cl.

| | |
|---|---|
| ***F25B 1/10*** | (2006.01) |
| ***F25B 40/02*** | (2006.01) |
| ***F25B 41/04*** | (2006.01) |
| ***F25B 49/02*** | (2006.01) |

(52) U.S. Cl.

CPC ..... *F25B 49/022* (2013.01); *F25B 2339/047* (2013.01); *F25B 2400/0403* (2013.01); *F25B 2400/0409* (2013.01); *F25B 2400/0411* (2013.01); *F25B 2400/0417* (2013.01); *F25B 2400/13* (2013.01); *F25B 2600/2501* (2013.01); *F25B 2700/195* (2013.01); *F25B 2700/197* (2013.01); *F25B 2700/21161* (2013.01); *F25B 2700/21163* (2013.01); *F25B 2700/21172* (2013.01); *F25B 2700/21173* (2013.01)

(56) References Cited

U.S. PATENT DOCUMENTS

| | | | | |
|---|---|---|---|---|
| 2010/0191487 | A1* | 7/2010 | Rada | G05F 1/70 702/60 |
| 2011/0022239 | A1* | 1/2011 | Forbes, Jr. | G06Q 10/00 700/286 |
| 2011/0115223 | A1* | 5/2011 | Stahlkopf | F01K 13/02 290/7 |
| 2013/0291576 | A1 | 11/2013 | Wada et al. | |

FOREIGN PATENT DOCUMENTS

| | | | |
|---|---|---|---|
| JP | 06-327136 | A | 11/1994 |
| JP | 10-009687 | A | 1/1998 |
| JP | 2000-018673 | A | 1/2000 |
| JP | 2000-234787 | A | 8/2000 |
| JP | 2001-241740 | A | 9/2001 |
| JP | 3216749 | B2 | 10/2001 |
| JP | 3240440 | B2 | 12/2001 |
| JP | 2004-218970 | A | 8/2004 |
| JP | 2004-239537 | A | 8/2004 |
| JP | 2007-255759 | A | 10/2007 |
| JP | 2009-041830 | A | 2/2009 |
| JP | 2009243758 | A | 10/2009 |
| JP | 4764222 | B2 | 8/2011 |
| WO | 2012/101902 | A1 | 8/2012 |

OTHER PUBLICATIONS

Written Opinion dated Apr. 23, 2013, issued in corresponding application No. PCT/JP2013/053137.

Office Action dated Feb. 16, 2016, issued in counterpart Chinese Application No. 201380005456.0, with English translation (16 pages).

Office Action dated Dec. 1, 2015, issued in counterpart Japanese application No. 2012-028618, with English translation (12 pages).

Office Action dated Jul. 5, 2016, issued in counterpart Japanese Application 2012-028618, with English translation. (12 pages).

Office Action dated Nov. 11, 2016, issued in counterpart German Application No. 11 2013 000 956.0, with English translation. (8 pages).

Office Action dated Dec. 6, 2016, issued in counterpart Japanese Application No. 2012-028618 (3 pages). Concise English language explanation of relevance: The Decision of Patent Grant has been received.

* cited by examiner

HEAT SOURCE SYSTEM AND METHOD FOR CONTROLLING NUMBER OF MACHINES TO BE STARTED AT TIME OF POWER RECOVERY IN HEAT SOURCE SYSTEM

TECHNICAL FIELD

The present invention relates to a heat source system having a plurality of heat source machines and a method for controlling the number of machines to be started at the time of power recovery in the heat source system.

BACKGROUND ART

As a recovery sequence at the time of power recovery in a heat source system having a plurality of heat source machines, there is known a method disclosed in PTL 1 for example. PTL 1 discloses an apparatus for controlling the number of machines in operation that is adapted to control the number of heat source machines. When a power failure occurs, the apparatus determines whether the power failure is a momentary power failure or not. If the power failure is determined to be a momentary power failure, the number of the heat source machines to be operated at the time of power recovery is controlled based on either a load condition or an operating state of the heat source machines immediately before the momentary power failure.

CITATION LIST

Patent Literature

{PTL 1}
The Publication of Japanese Patent No. 3240440

SUMMARY OF INVENTION

Technical Problem

In the heat source system disclosed in PTL 1, it is presumed that the apparatus for controlling the number of machines in operation operates by sharing power from an uninterruptible power supply. Therefore, the system requires an installation cost and a maintenance cost of the uninterruptible power supply, which poses a disadvantage in terms of cost. Further, in the invention disclosed in PTL 1, control is complicated since the control is performed based on the determination of whether the power failure occurred is a power failure or a momentary interruption.

When the uninterruptible power supply is not used, manual restoring operation by an operator is needed. In this case, the operator starts heat source machines in stages, while checking a balance between a required load of an external load and an output of the heat source machines. Accordingly, it takes time to restore the state as it was before the power failure.

There has also been known a heat source machine having an automatic restart function. The automatic restart function is adapted to cause a heat source machine, which has been started when a power failure occurs, to automatically restart at the time of power recovery. If the heat source machine having such an automatic restart function is used, it can be expected that the state before the power failure is restored promptly and automatically at the time of power recovery.

However, in the conventional heat source system, when power supply to the apparatus for controlling the number of machines in operation was interrupted, the control state was reset. Consequently, even though each of the heat source machines restarted at the time of power recovery with the aid of the automatic restart function, a mismatch occurred between the control state and the number of the heat source machines in operation. This caused a problem that proper control could not be performed after the power recovery. For example, the number of the heat source machines, which were instructed to be started by the apparatus for controlling the number of machines, was different in some cases from the number of heat source machines actually started. Thus, the apparatus for controlling the number of machines might be impossible to correctly control the number of heat source machines.

An object of the present invention is to provide a heat source system capable of swiftly starting, at the time of power recovery after a power failure, heat source machines, the number of which is equal to the number of machines in operation before the power failure, without including an uninterruptible power supply in an apparatus for controlling the number of machines that is adapted to control the number of heat source machines, and to provide a method for controlling the number of machines to be started at the time of power recovery in the heat source system.

Solution to Problem

A first aspect of the present invention is a heat source system, including: a plurality of heat source machines; and a host control apparatus that provides a starting command to each of the heat source machines and that is not connected to an uninterruptible power supply, wherein the host control apparatus includes a nonvolatile first storage unit that stores the number of heat source machines in operation immediately before a power failure, and starts the heat source machines in accordance with the number of the heat source machines stored in the first storage unit when power is recovered.

According to such a heat source system, the first storage unit stores the number of heat source machines in operation immediately before the power failure. As a consequence, even when power supply to the host control unit is interrupted by occurrence of a power failure, the number of the heat source machines in operation immediately before the power failure can be grasped by reading out information from the first storage unit at the time of power recovery. Therefore, by starting the heat source machines based on the number of the heat source machines, it becomes possible to restore the state of the heat source machines as it was before the power failure.

According to the heat source system, even when each of the heat source machines has an automatic restart function and even when the heat source machines restart themselves after power recovery with the aid of the automatic restart function, i.e., even when the heat source machines automatically restart themselves without waiting for a start instruction from the host control apparatus, it becomes possible to match the number of the heat source machines in operation and the number of machines in operation grasped by the host control apparatus.

In the heat source system, the host control apparatus may include a nonvolatile second storage unit that stores a start priority of the heat source machines, and may start the heat source machines in accordance with the start priority of the heat source machines stored in the second storage unit when power is recovered.

This makes it possible to preferentially start the heat source machines higher in the start priority.

In the heat source system, the host control apparatus may include a startability sensing unit that detects whether or not each of the heat source machines is in a startable state, and may preferentially start startable heat source machines when power is recovered.

Assume the case where the heat source machines are started in accordance with the start priority as described above. In this case, if, for example, a heat source machine with the highest start priority is not in a startable state due to a certain factor, the start instruction cannot be issued until the heat source machine regains the startable state. Even in such a case, if the heat source machines in the startable state are preferentially started, it becomes possible to swiftly start the control on the number of machines after power recovery.

In the above-stated heat source system, the first storage unit may store, instead of the number of the heat source machines, identification information on the heat source machines in operation immediately before the power failure, and may start the heat source machines in accordance with the identification information on the heat source machines stored in the first storage unit when power is recovered.

According to such a configuration, the first storage unit stores the identification information on the heat source machines in operation immediately before the power failure. Accordingly, at the time of power recovery, reading out the information from the first storage unit makes it possible to grasp the heat source machines in operation immediately before the power failure. Therefore, by starting the heat source machines based on the information, the state immediately before the power failure can be restored.

In the heat source system, the first storage unit may store, instead of the number of the heat source machines, a required load of an external load immediately before the power failure. When power is recovered, the host control apparatus may determine the number of the heat source machines to be started at the time of power recovery, based on the required load of the external load stored in the first storage unit.

According to such a configuration, the first storage unit stores the required load of the external load immediately before the power failure. Accordingly, at the time of power recovery, the required load of the external load immediately before the power failure can be grasped by reading out the information from the first storage unit, and the number of the heat source machines in operation immediately before the power failure can be grasped based on the information. This makes it possible to swiftly restore the state immediately before the power failure.

In the heat source system, when the number of the heat source machines stored in the first storage unit is one or more, the host control apparatus may determine that power is recovered, and may start the heat source machines in accordance with the number of the heat source machines stored in the first storage unit.

Thus, based on whether or not the number of the heat source machines stored in the first storage unit is one or more, it becomes possible to reliably determine whether the machines are restarted after power recovery from a power failure or restarted not after a power failure but after normal shutdown. Therefore, the number of the heat source machines may properly be controlled in response to the cause of shutdown.

A second aspect of the present invention is a method for controlling the number of machines at a time of power recovery in a heat source system including a plurality of heat source machines, the method including: storing the number of the heat source machines in operation before a power failure; and starting the heat source machines at the time of power recovery in accordance with the stored number of the heat source machines.

Advantageous Effects of Invention

The present invention can achieve an effect of swiftly starting, at the time of power recovery after a power failure, heat source machines, the number of which is equal to the number of machines before the power failure, without including an uninterruptible power supply in an apparatus for controlling number of machines that is adapted to control the number of heat source machines.

DESCRIPTION OF EMBODIMENTS

Hereinbelow, a heat source system and a method for controlling the number of machines started at the time of power recovery in the heat source system according to one embodiment of the present invention will be described with reference to accompanying drawings.

Figure 1:
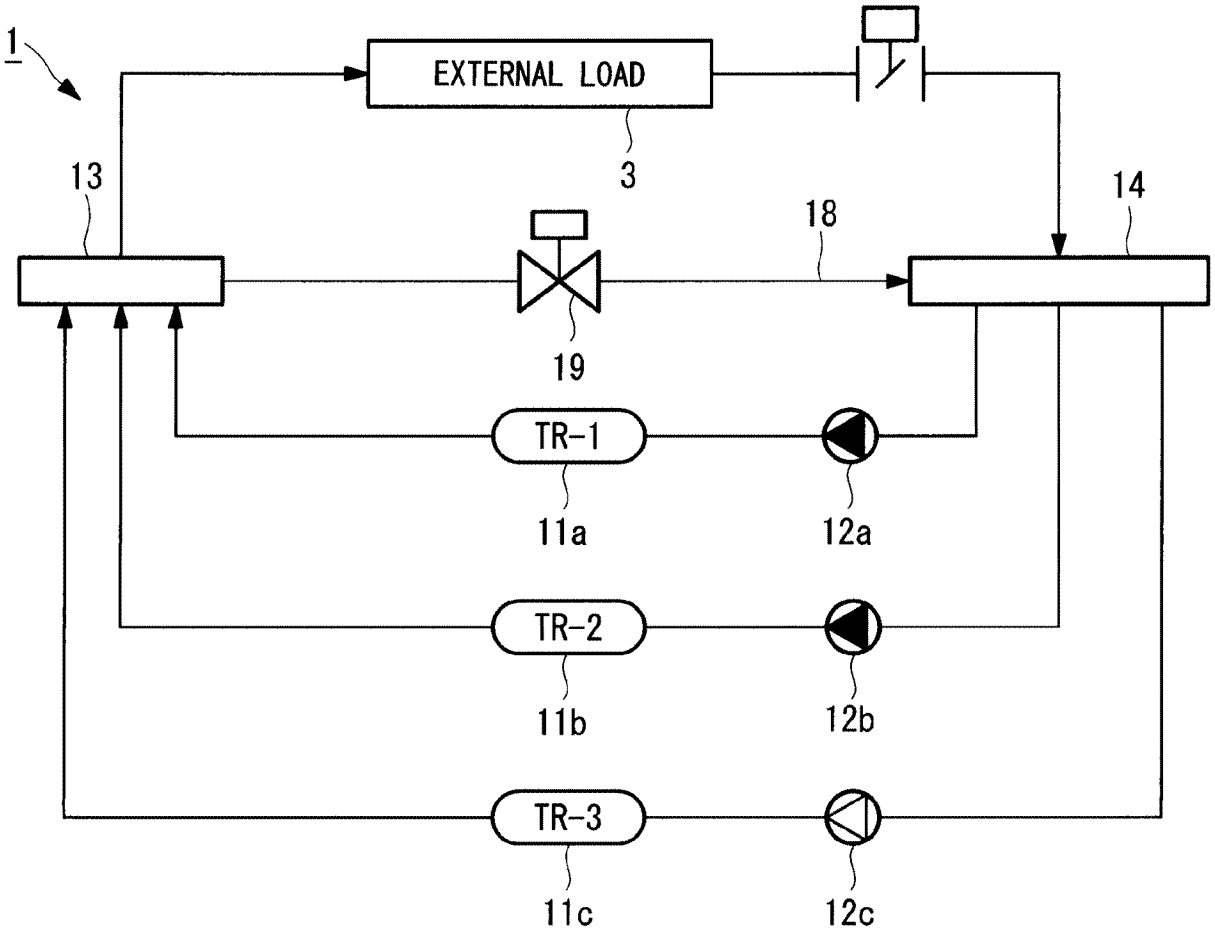
FIG. 1 is a schematic view illustrating an overall configuration of a heat source system according to one embodiment of the present invention.

FIG. 1 is a schematic view illustrating the configuration of a heat source system 1 according to one embodiment of the present invention. The heat source system 1 includes, for example, a plurality of heat source machines 11*a*, 11*b*, and 11*c* that provide cold heat to chilled water (heat carrier) that is supplied to an external load 3 such as air conditioners, water heaters, and plants. Although FIG. 1 illustrates a case where three heat source machines 11*a*, 11*b*, and 11*c* are placed, the number of the heat source machines to be placed may arbitrarily be determined.

Chilled water pumps 12*a*, 12*b*, and 12*c* that pump chilled water are each placed upstream of the respective heat source machines 11*a*, 11*b*, and 11*c* as viewed in a chilled water flow. The chilled water from a return header 14 is sent to each of the heat source machines 11*a*, 11*b*, and 11*c* by the chilled water pumps 12*a*, 12*b*, and 12*c*. Each of the chilled water pumps 12*a*, 12*b*, and 12*c* is driven by an inverter motor (illustration omitted). Accordingly, a variable speed is obtained, so that variable flow control is performed.

The chilled water obtained in each of the heat source machines 11*a*, 11*b*, and 11*c* is collected in the supply header 13. The chilled water collected in the supply header 13 is supplied to the external load 3. The chilled water is used for air conditioning and the like in the external load 3 and is heated thereby. The chilled water is then sent to the return header 14. The chilled water is made to diverge in the return header 14, and is sent to each of the heat source machines 11*a*, 11*b*, and 11*c*.

A bypass pipe 18 is provided between the supply header 13 and the return header 14. By adjusting the opening of a bypass valve 19 provided on the bypass pipe 18, the amount of chilled water supplied to the external load 3 can be adjusted.

Figure 2:
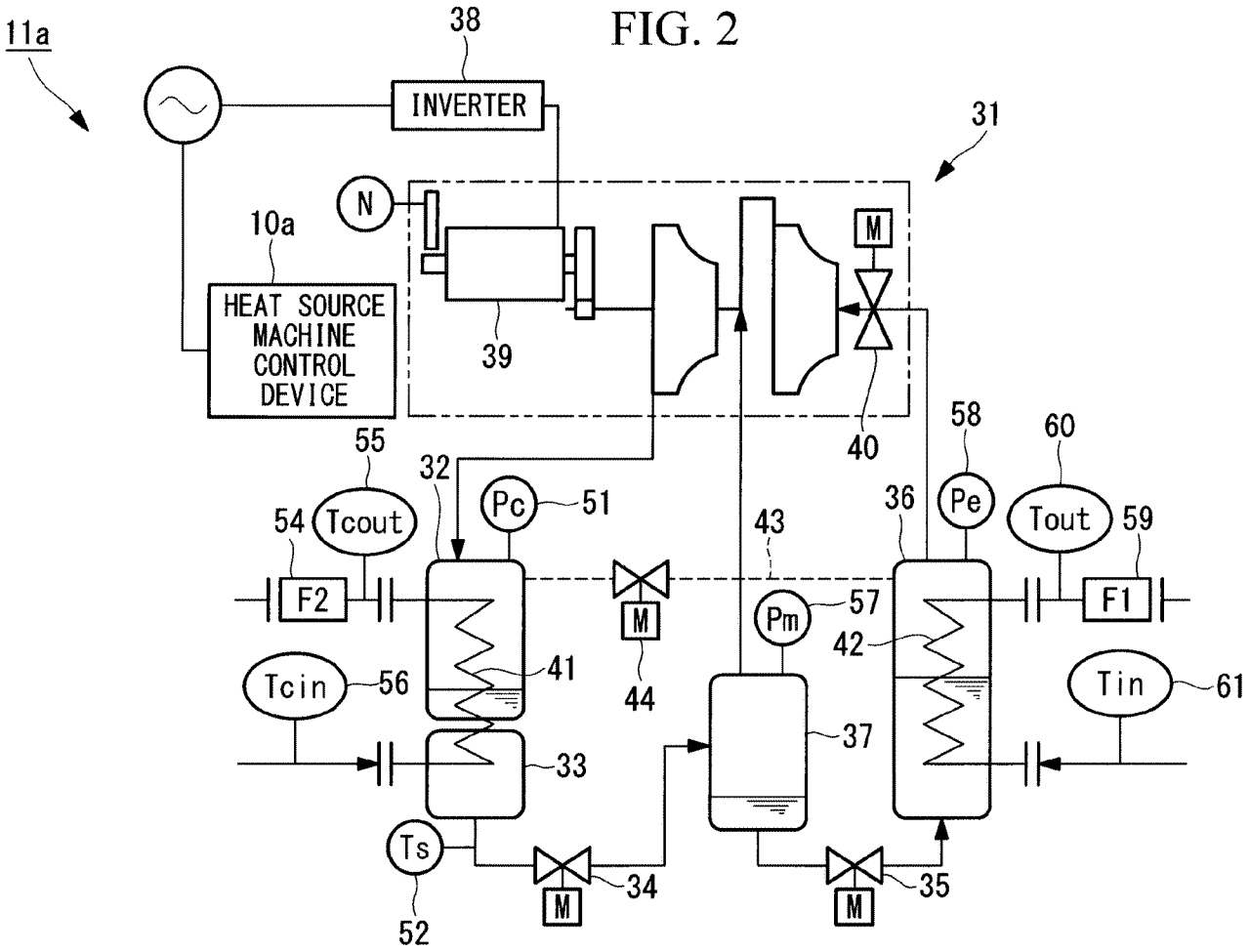
FIG. 2 illustrates one configuration example of heat source machines illustrated in FIG. 1.

FIG. 2 illustrates a detailed configuration of a centrifugal chiller (Turbo chiller) applied to the heat source machines 11*a*, 11*b*, and 11*c*. In FIG. 2, out of three heat source machines provided in parallel, only one heat source machine 11*a* is illustrated for easier understanding.

The heat source machine 11*a* is configured to realize a two-stage compression and two-stage expansion subcooling cycle. The heat source machine 11*a* includes a turbocompressor 31 that compresses a refrigerant, a condenser 32 that condenses a high-temperature/high-pressure gas refrigerant compressed by the turbocompressor 31, a subcooler 33 that supercools the liquid refrigerant condensed in the condenser 32, a high pressure expansion valve 34 that expands the liquid refrigerant from the subcooler 33, an intercooler 37 connected to the high pressure expansion valve 34 while being connected to an intermediate stage of the turbocompressor 31 and a low voltage expansion valve 35, and an evaporator 36 that evaporates the liquid refrigerant expanded by the low voltage expansion valve 35.

The turbocompressor 31 is a centrifugal two-stage compressor, which is driven by an electric motor 39 whose speed is controlled by the inverter 38. The output of the inverter 38 is controlled by a heat source machine control apparatus 10*a*. The turbocompressor 31 may be a fixed-speed compressor having a constant speed. An inlet guide vane (hereinafter referred to as "IGV") 40, which controls the flow rate of a sucked refrigerant, is provided in a refrigerant suction port of the turbocompressor 31 to enable capacity control of the heat source machine 11*a*.

The condenser 32 is equipped with a pressure sensor 51 for measuring a condensed refrigerant pressure Pc. The output of the pressure sensor 51 is transmitted to the heat source machine control device 10*a*.

The subcooler 33 is provided downstream of the condenser 32 in the refrigerant flow so as to supercool the condensed refrigerant. Immediately after the subcooler 33 on a downstream side in the refrigerant flow, a temperature sensor 52 is provided to measure a temperature Ts of the refrigerant after being supercooled.

A heat transfer tube for cooling 41 is made to pass through the condenser 32 and the subcooler 33 for cooling the condenser 32 and the subcooler 33. A flow meter 54 measures a flow rate F2 of the cooling water, a temperature sensor 55 measures an outlet temperature Tcout of the cooling water, and a temperature sensor 56 measures an inlet temperature Tcin of the cooling water. Heat of the cooling water is exhausted to the outside in the cooling tower not illustrated, and is then guided to the condenser 32 and the subcooler 33 again.

The intercooler 37 is equipped with a pressure sensor 57 for measuring an intermediate pressure Pm. The evaporator 36 is equipped with a pressure sensor 58 for measuring an evaporating pressure Pe. Heat is absorbed in the evaporator 36 so as to provide chilled water having a rated temperature (for example, 7° C.). A heat transfer tube for chilled water 42 is made to pass through the evaporator 36 to cool the chilled water supplied to the external load 3 (see FIG. 1). The flow meter 59 measures a flow rate F1 of the chilled water, the temperature sensor 60 measures an outlet temperature Tout of the chilled water, and the temperature sensor 61 measures an inlet temperature Tin of the chilled water.

A hot gas bypass pipe 43 is provided between a gas phase portion of the condenser 32 and a gas phase portion of the evaporator 36. A hot gas bypass valve 44 is provided to control the flow rate of the refrigerant passing through the hot gas bypass pipe 43. By adjusting the flow rate of the bypassing hot gas with the hot gas bypass valve 44, capacity control of a very small area, which is not sufficiently controlled by the IGV 40, becomes possible.

A description has been made of the case where the heat source machine 11*a* illustrated in FIG. 2 includes the condenser 32 and the subcooler 33, and heat exchange is performed between the refrigerant and the cooling water whose heat is exhausted to the outside in the cooling tower to heat the cooling water. However, the heat source machine 11*a* may be configured so that an air heat exchanger is placed in place of the condenser 32 and the subcooler 33. In the air heat exchanger, heat exchange may be performed between outside air and the refrigerant.

The heat source machines 11*a*, 11*b*, and 11*c* applied to the present embodiment are not limited to the above-stated the centrifugal chiller (turbo chiller) having only the cooling function. For example, the heat source machines may have only a heating function or having both the cooling function and the heating function. A medium that is made to exchange heat with the refrigerant may be water or air. The heat source machines 11*a*, 11*b*, and 11*c* may be constituted of the heat source machines of the same kind, or be constituted of several kinds of heat source machines.

Figure 3:
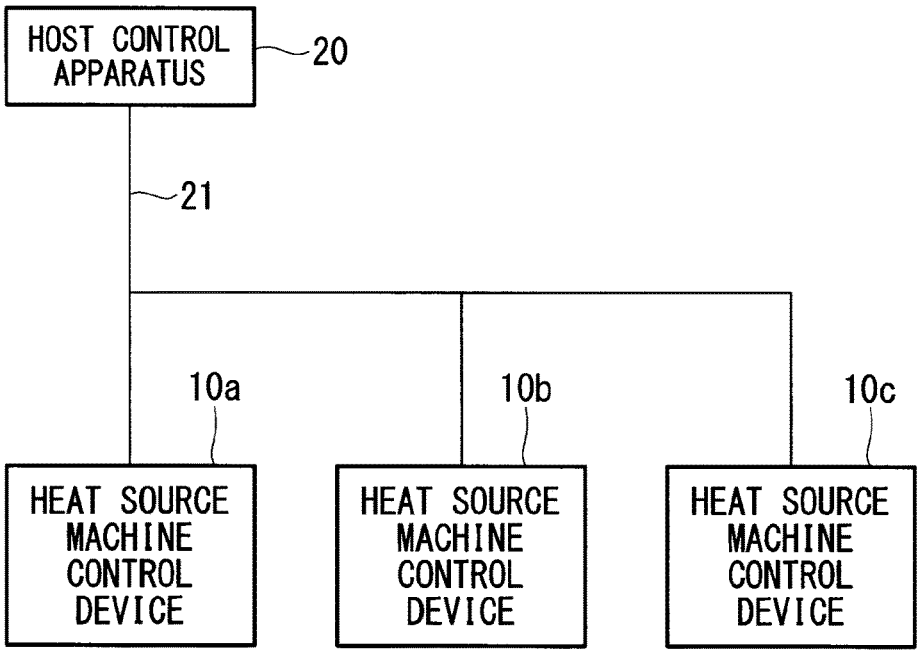
FIG. 3 is a schematic view illustrating the configuration of a control system in the heat source system according to the one embodiment of the present invention.

FIG. 3 is a schematic view illustrating the configuration of a control system in the heat source system 1 illustrated in FIG. 1. As illustrated in FIG. 3, heat source machine control device 10*a*, 10*b*, and 10*c*, which serve as control devices of the respective heat source machines 11*a*, 11*b*, and 11*c*, are configured to be connected to a host control apparatus 20 via a communication medium 21 to enable bidirectional communication. For example, the host control apparatus 20 is adapted to control the whole heat source system. For example, the host control apparatus 20 has a function of controlling the number of machines that is adapted to control the number of the heat source machines 11*a*, 11*b*, and 11*c* to be started for the required load of the external load 3.

For example, the host control apparatus 20 and the heat source machine control devices 10*a*, 10*b*, and 10*c* are computers each including a central processing unit (CPU), a main memory unit such as random access memories (RAMs), an auxiliary storage unit, and a communication device that communicates with external devices to exchange information.

The auxiliary storage unit is a computer readable recording medium, such as magnetic discs, magneto-optical disks, CD-ROMs, DVD-ROMs, and semiconductor memories. The auxiliary storage unit stores various kinds of programs.

The CPU reads out programs from the auxiliary storage unit to the main memory unit, and executes the programs to implement various processes.

Figure 4:
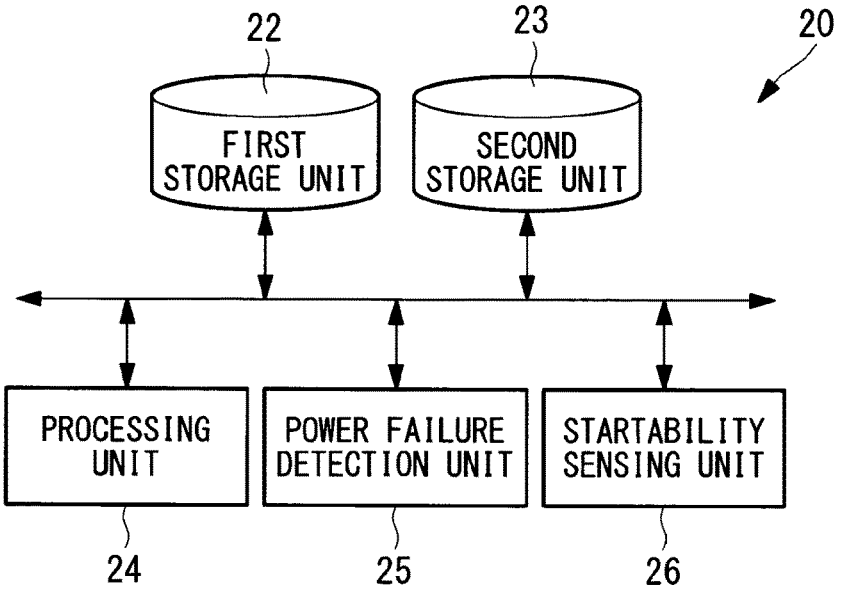
FIG. 4 is a functional block diagram illustrating main functions with respect to a function of controlling the number of heat source machines, among the functions included in a host control apparatus illustrated in FIG. 3.

FIG. 4 is a functional block diagram illustrating main functions with respect to the function of controlling the number of heat source machines, among the functions included in the host control apparatus 20.

As illustrated in FIG. 4, the host control apparatus 20 includes a first storage unit 22, a second storage unit 23, a processing unit 24, a power failure detection unit 25, and a startability sensing unit 26 as main components.

Here, a nonvolatile memory is applied as the first storage unit 22 and the second storage unit 23, so that memory contents are not erased at the time of a power failure.

The first storage unit 22 is adapted to store the number of heat source machines in operation immediately before the power failure. For example, when the number of the heat source machines is controlled by the host control apparatus 20, the number of the heat source machines in operation is written in the first storage unit 22. For example, an updated number of the heat source machines may be written in the first storage unit 22 whenever the processing unit 24 changes the number of the started heat source machines. As a consequence, when a power failure occurs, the number of heat source machines in operation immediately before the power failure ends up to be the number stored in the first storage unit 22.

The start priority of the heat source machines 11*a*, 11*b*, and 11*c* is preset in the second storage unit 23. In the following description, the heat source machine 11*a* has a highest start priority, the heat source machine 11*b* has a second highest start priority, and the heat source machine 11*c* has a third highest start priority for the purpose of illustration.

The power failure detection unit 25 senses occurrence of a power failure. A voltage decline in the host control apparatus 20 is used for sensing the power failure. For example, when a power failure occurs, a supply voltage to the CPU gradually declines, so that some time (for example, about hundreds of ms) can be secured during a period from occurrence of the power failure to shutdown of the CPU. Therefore, the power failure detection unit 25 performs power failure detection by using this time. For example, the power failure detection unit detects a power failure when the voltage supplied to the CPU or other devices becomes equal to or below a specified threshold value (set higher than the lowest operating voltage of the CPU) set in advance. The power failure detection unit then sets a power failure flag to 1. The power failure flag is written in, for example, a nonvolatile memory so that the value is not erased when a power failure occurs. When a power failure does not occur, the power failure flag is set equal to 0.

When power is recovered, the startability sensing unit 26 detects startable heat source machines. For example, when communication with each of the heat source machine control devices 10*a*, 10*b*, and 10*c* is recovered after a power failure, the startability sensing unit 26 determines that the heat source machines corresponding to the heat source machine control devices are startable. When it is confirmed that the heat source machine control devices 10*a*, 10*b*, and 10*c* are in a mode of receiving remote control or that power supply to the heat source machines 10*a*, 10*b*, and 10*c* is not interrupted, the heat source machines are also determined to be startable.

The processing unit 24 writes the number of heat source machines currently in operation in the first storage unit 22 as described above. When power is recovered, the processing unit 24 determines heat source machines to be started, based on the information stored in the first storage unit 22 and the second storage unit 23 and based on the information on the number of the startable heat source machines notified from the startability sensing unit 26. The processing unit 24 then outputs a starting command to the determined heat source machines.

A method for controlling the number of heat source machines implemented by the above-configured host control apparatus 20 will be described below with reference to FIG. 5.

First, when a power failure does not occur, the number of the heat source machines is controlled in accordance with a required load of the external load 3. Publicly known techniques may be employed for controlling the number of the machines. The processing unit 24 writes the number of the heat source machines in the first storage unit 22 whenever the number of the heat source machines in operation is changed (step SA1 in FIG. 5).

Next, when a power failure occurs, the power failure detection unit 25 senses occurrence of the power failure (step SA2), and the power failure flag is set to 1. Since an uninterruptible power supply is not included in any one of the host control apparatus 20 or the respective heat source machines 11*a*, 11*b*, and 11*c*, they are shut down upon interruption of power supply due to the power failure (step SA3).

Next, at the time of power recovery, the processing unit 24 of the host control apparatus 20 confirms the power failure flag of the power failure detection unit 25 (step SA4). When it is confirmed that the power failure flag is equal to 1, control on the number of the machines at the time of power recovery is performed. In the control on the number of machines at the time of power recovery, the processing unit 24 first reads out the number of heat source machines stored in the first storage unit 22 and the start priority stored in the second storage unit 23 (step SA5).

Next, the startability sensing unit 26 detects startable heat source machines, and outputs the information on the startable heat source machines to the processing unit 24 (step SA6).

The processing unit 24 determines the heat source machines to be started based on the number of heat source machines read out from the first storage unit 22, i.e., the number of heat source machines in operation before the power failure, the start priority read out from the second storage unit 23, and the information on the startable heat source machines acquired from the startability sensing unit 26. The processing unit 24 then outputs a starting command to the determined heat source machines (step SA7).

Assume the case where the number of heat source machines stored in the first storage unit 22 is two for example. In this case, when the heat source machines determined based on the start priority are the heat source machines 11*a* and 11*b* and these heat source machines 11*a* and 11*b* have been detected to be startable by the startability sensing unit 26, then the heat source machines 11*a* and 11*b* are determined as the heat source machines to be started, and the starting command is outputted to these two machines.

Contrary to the above case, if these heat source machines 11*a* and 11*b* include a heat source machine not detected to be startable, then it is confirmed whether the heat source machine 11*c* which has a next highest priority is startable. If the heat source machine 11*c* is startable, the heat source machine 11*c* is determined to be the heat source machine to be started as a substitute of the heat source machine which has been determined to be unstartable. Instead of the above sequence, after both the heat source machines 11*a* and 11*b* determined based on the start priority are detected to be startable, a starting command may be outputted to these two machines.

When the number of the machines in operation stored in the first storage unit 22 is zero, a starting command is not outputted to any one of the heat source machine control devices 10*a*, 10*b*, and 10*c*.

Thus, each of the heat source machine control devices which received the starting command from the host control apparatus 20 starts start-up operation, and once the start-up operation is completed, a message notifying completion of start-up operation is transmitted to the host control apparatus 20 from each of the heat source machine control devices. The host control apparatus 20 confirms that the number of the heat source machines which notified completion of start-up operation matches the number of the machines in operation stored in the first storage unit 22 ("YES" in step SA8), and ends the control on the number of heat source machines at the time of power recovery.

Figure 5:
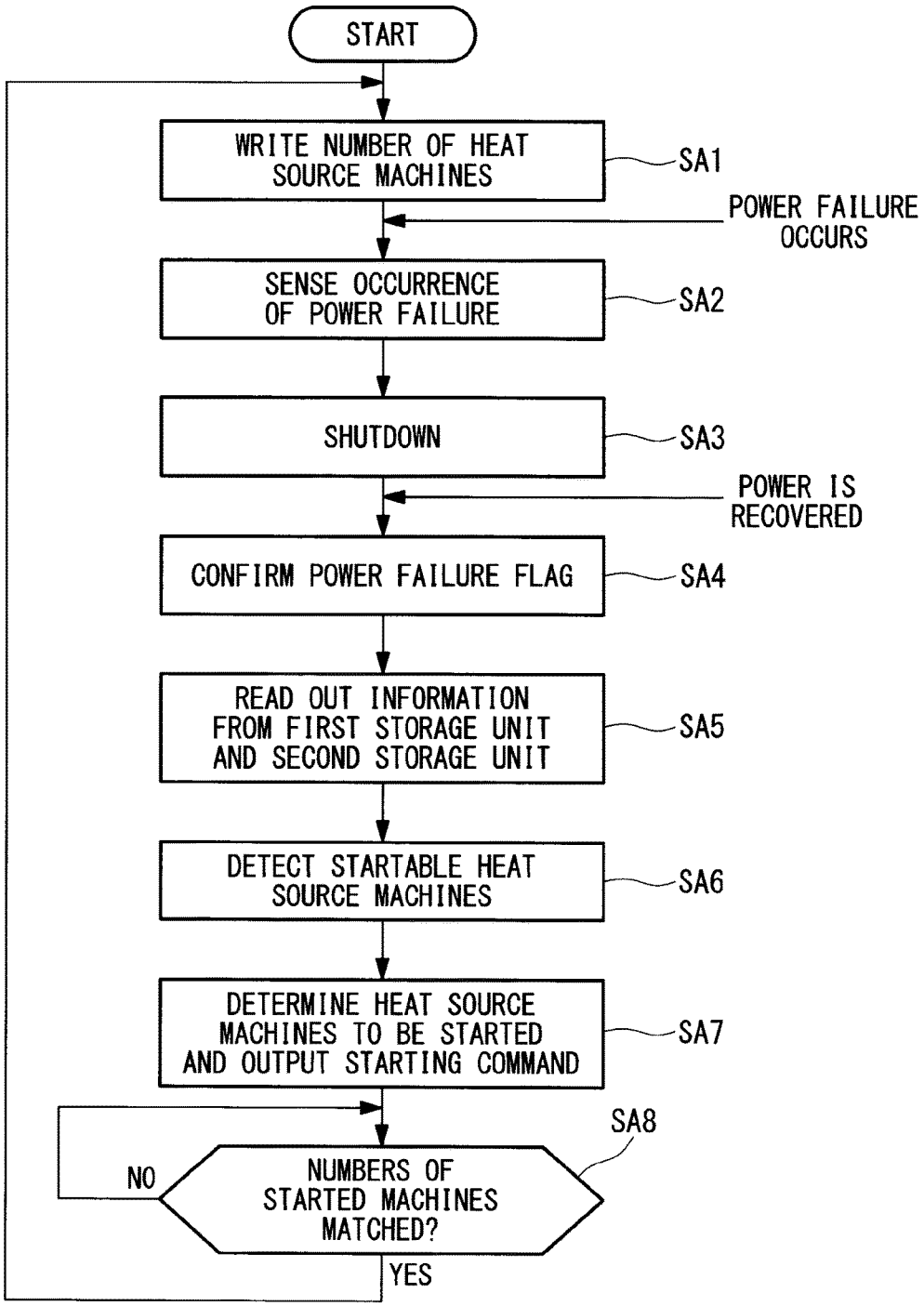
FIG. 5 is a flow chart illustrating procedures of a method for controlling the number of heat source machines in the heat source system according to the one embodiment of the present invention.

After the above sequence, normal control on the number of heat source machines, that is for example, control on the number of the heat source machines based on the required load of the external load 3, is performed, and the number of the heat source machines in operation is written in the first storage unit 22 by the processing unit 24 (step SA1 in FIG. 5).

As described in the foregoing, according to the heat source system 1 and the method for controlling the number of machines started at the time of power recovery in the heat source system in the present embodiment, the number of the heat source machines in operation immediately before the power failure is stored in the first storage unit 22. Accordingly, at the time of power recovery, the information in the first storage unit 22 is read out, and the heat source machines are started based on the information, so that the system can automatically and swiftly restore the state before the power failure.

According to the heat source system 1 and the method for controlling the number of machines started at the time of power recovery in the heat source system in the present embodiment, it is not necessary to include an uninterruptible power supply in the host control apparatus 20 and each of the heat source machines 11*a*, 11*b*, and 11*c*. This makes it possible to achieve cost reduction.

When each of the heat source machines 11*a*, 11*b*, and 11*c* has an automatic restart function, the host control apparatus 20 conventionally has a problem of being unable to recognize the heat source machines automatically restored by the automatic restart function. However, according to the heat source system 1 in the present embodiment, the number of the heat source machines in operation immediately before a power failure is stored. Accordingly, even if each of the heat source machines 11*a*, 11*b*, and 11*c* starts by the automatic restart function independently of a starting command from the host control apparatus 20, the starting command is still outputted to these heat source machines later by the host control apparatus 20. In this case, since the heat source machines have already started, the starting command is ineffective. However, even in such a case, it becomes possible to match the number of the heat source machines started by the automatic restart function and the number of the started heat source machines recognized by the host control apparatus 20.

Thus, the control on the number of machines started at the time of power recovery in this embodiment can similarly be applied to both the heat source machines with and without the automatic restart function.

Figure 6:
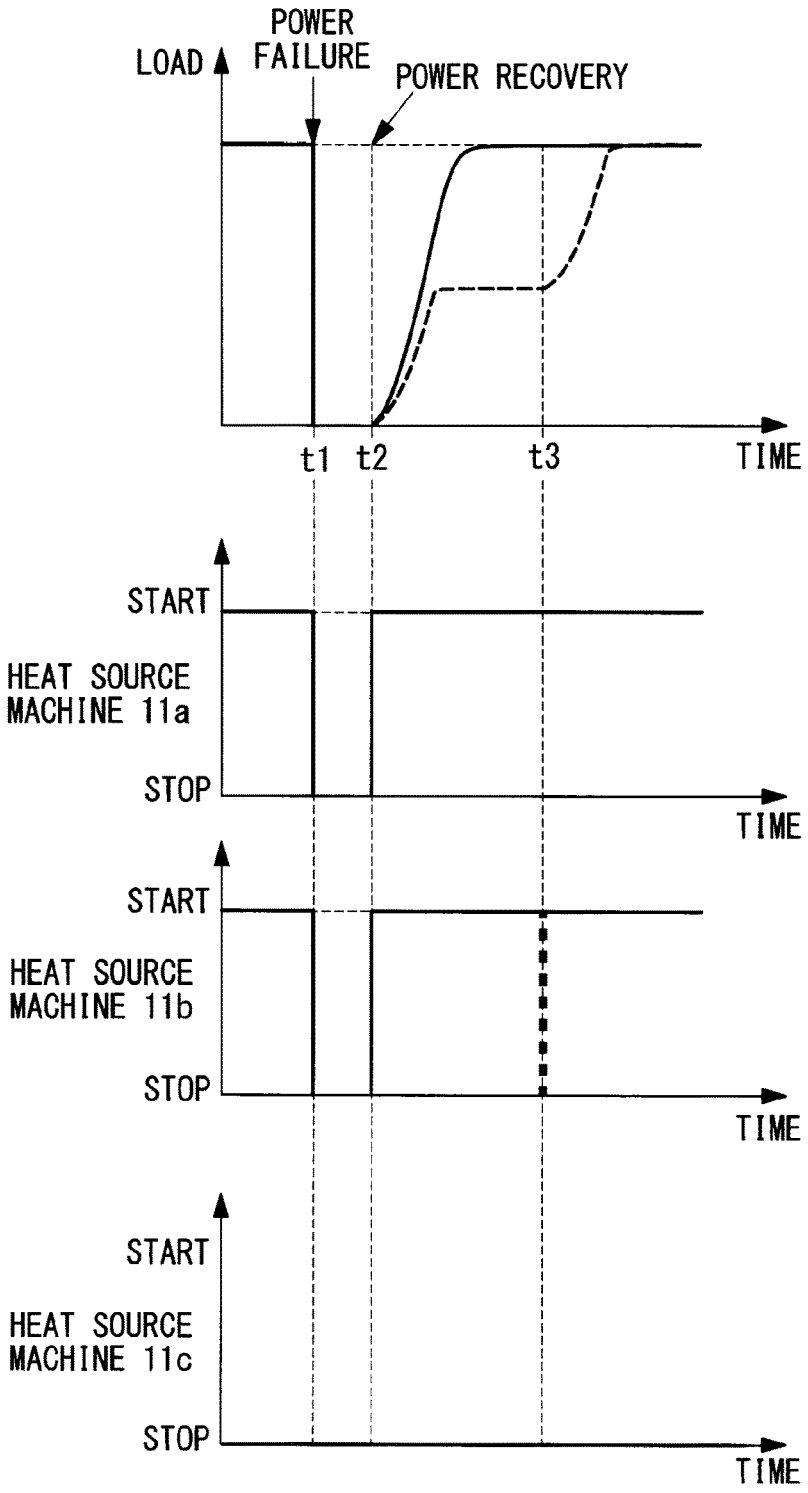
FIG. 6 illustrates comparison between time taken for recovery in the case where an operator manually performs a recovery work at the time of power recovery and time taken for recovery in the heat source system according to the present embodiment.

FIG. 6 illustrates comparison between time taken for recovery in the case where an operator manually performs a recovery work at the time of power recovery and time taken for recovery in the heat source system 1 according to the present embodiment.

For example, in a conventional case as illustrated with a broken line in FIG. 6, an operator first starts one heat source machine 11*a* at the time of power recovery (time t2), and compares an output of the heat source machine 11*a* with a target load by the external load 3. If the output of the one heat source machine 11*a* is not enough, the operator starts the second heat source machine 11*b* (time t3). Thus, in the conventional case, the heat source machines are started one machine at a time, while a balance between the output of the heat source machines and the required load is being checked. Consequently, it takes considerable time to restore the state before the power failure.

Contrary to this, in the heat source system 1 according to the present embodiment, the number of the heat source machines in operation before the power failure is stored. Accordingly, as illustrated with a solid line in FIG. 6, the heat source machines, the number of which is equal to the stored number, can swiftly be started at the time of power recovery (time t2). As a consequence, it becomes possible to promptly return the number of the started machines to the number before the power failure.

In the embodiment described above, the first storage unit 22 stores the number of the heat source machines in operation. Instead of this, identification information on the heat source machines in operation may be recorded. By storing the identification information in this way, the heat source machines in operation immediately before the power failure can reliably be grasped at the time of power recovery.

The first storage unit 22 may store, instead of the number of machines in operation, a required load of the external load 3 immediately before a power failure. At the time of power recovery, a starting command may be outputted to the heat source machines, the number of which is in proportional to the required load of the external load 3. Thus, the same effect can also be achieved by storing the required load of the external load 3 in the first storage unit 22.

In the present embodiment, in the case where the host control apparatus 20 also controls frequencies of auxiliary machines such as the chilled water pump 12*a*, 12*b*, and 12*c*, and the cooling tower (illustration omitted), based on the required load notified from the external load 3, rated frequencies may be outputted to these auxiliary machines as a control command at the time of power recovery. After that, the control mode may be shifted to normal control.

For example, the host control apparatus 20 may have a function of acquiring a period of interruption at the time of power recovery. When the interruption period is longer than a threshold value set in advance, the heat source machines may not be started at the time of power recovery.

Figure 7:
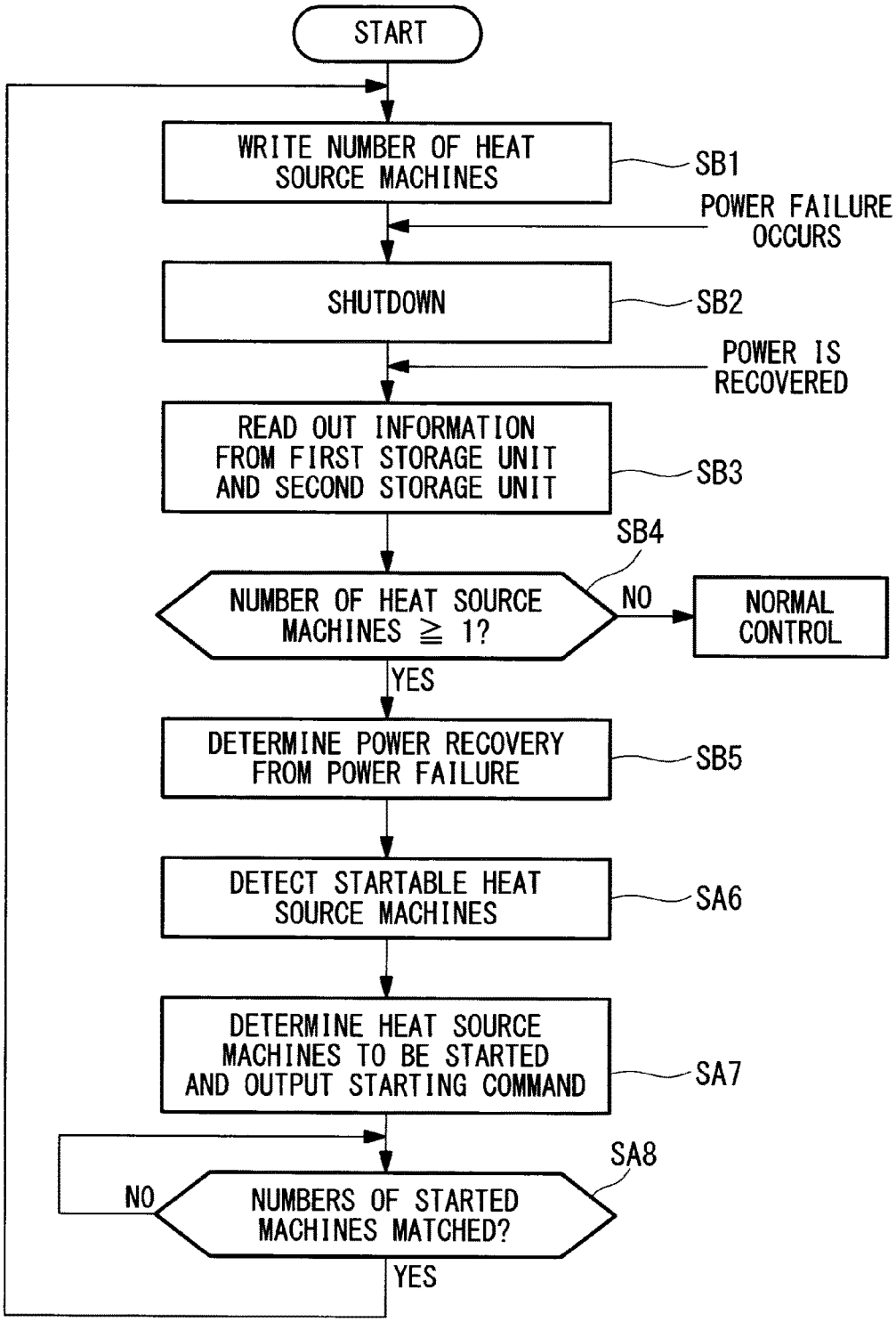
FIG. 7 is a flow chart illustrating procedures of a method for controlling the number of heat source machines in a heat source system according to another embodiment of the present invention.

In the present embodiment, the power failure detection unit 25 determines power recovery from the power failure by writing the power failure flag in the nonvolatile memory. Instead of this, the host control apparatus 20 may execute a method for controlling the number of heat source machines as illustrated in FIG. 7.

First, when a power failure does not occur, the number of the heat source machines is controlled in accordance with a required load of the external load 3. The number of the heat source machines is written in the first storage unit 22 whenever the number of the heat source machines in operation is changed (step SB1 in FIG. 7). This processing is the same as that of the above-stated step SA1 in FIG. 5.

Next, when a power failure occurs, the host control apparatus 20 and the respective heat source machines 11*a*, 11*b*, and 11*c* are shut down upon interruption of power supply due to the power failure since they do not include an uninterruptible power supply (step SB2).

Next, at the time of power recovery, the processing unit 24 of the host control apparatus 20 reads out the number of heat source machines stored in the first storage unit 22 and the start priority stored in the second storage unit 23 (step SB3). Further, the processing unit 24 determines whether the number of the heat source machines stored in the first storage unit 22 is one or more (step SB4). As a result, if the number of the heat source machines is one or more, it is determined that shutdown is caused by occurrence of a power failure, i.e., restart is performed due to power recovery from the power failure (step SB5). Then, the processing similar to step SA6 to step SA8 and onward in FIG. 5 is executed.

On the contrary, if the number of the heat source machines stored in the first storage unit 22 is less than one, i.e., zero, in step SB4, then it is determined that restart is performed after normal shutdown, and the control on the number of machines in normal start-up is performed.

Thus, power failure detection is performed based on whether the number of the heat source machines stored in the first storage unit 22 is one or more. Therefore, the necessity of the power failure flag as described before can be eliminated.

REFERENCE SIGNS LIST

1 Heat source system
10*a*, 10*b*, 10*c* Heat source machine control device
11*a*, 11*b*, 11*c* Heat source machine
20 Host control apparatus
22 First Storage Unit
23 Second Storage Unit
24 Processing Unit
25 Power Failure Detection Unit
26 Startability Sensing Unit

The invention claimed is:

1. A heat source system, comprising:

a plurality of heat source machines that each includes a compressor, a condenser, and an evaporator, and that each heats or cools a refrigerant to supply the heated refrigerant or cooled refrigerant to a common external load; and a host control apparatus that controls a number of the heat source machines to be started according to a required load of the common external load and that is not connected to an uninterruptible power supply, wherein the host control apparatus includes a nonvolatile first storage unit that stores the number of heat source machines in operation immediately before a power failure of the host control apparatus and a startability sensing unit that detects whether or not each of the heat source machines is in a startable state, and the host control apparatus starts the heat source machines in accordance with the number of the heat source machines stored in the nonvolatile first storage unit and preferentially starts startable heat source machines when the host control apparatus is recovered from the power failure.

2. The heat source system according to claim 1, wherein the host control apparatus includes a nonvolatile second storage unit that stores a start priority of the heat source machines, and starts the heat source machines in accordance with the start priority of the heat source machines stored in the second storage unit when power is recovered.

3. The heat source system according to claim 1, wherein the first storage unit stores, instead of the number of the heat source machines, identification information on the heat source machines in operation immediately before the power failure, and when power is recovered, the host control apparatus starts the heat source machines in accordance with the identification information on the heat source machines stored in the first storage unit.

4. The heat source system according to claim 1, wherein the first storage unit stores, instead of the number of the heat source machines, a required load of an external load immediately before the power failure, and when power is recovered, the host control apparatus determines the number of the heat source machines to be started at a time of power recovery, based on the required load of the external load stored in the first storage unit.

5. The heat source system according to claim 1, wherein when the number of the heat source machines stored in the first storage unit is one or more, the host control apparatus determines that power is recovered, and starts the heat source machines in accordance with the number of the heat source machines stored in the first storage unit.

6. A method for controlling a number of heat source machines at a time of power recovery of a host control apparatus in association with a heat source system including a plurality of heat source machines that each includes a compressor, a condenser, and an evaporator, and that each heats or cools a refrigerant to supply the heated refrigerant or cooled refrigerant to a common external load, the method being implemented with a processor on the host control apparatus equipped with memory-stored executable instructions, which when executed by the processor, perform the method, comprising:

controlling, with the host control apparatus that is not connected to an uninterruptible power supply, a number of the heat source machines to be started according to a required load of the common external load;

storing, in a nonvolatile storage unit, a number of the heat source machines in operation immediately before a power failure of the host control apparatus;

detecting, with a startability sensing unit, whether or not each of the heat source machines is in a startable state; and starting, with the host control apparatus, the heat source machines in accordance with the number of the heat source machines stored in the nonvolatile storage unit and preferentially starting startable heat source machines when the host control apparatus is recovered from the power failure.

* * * * *